US006105750A

United States Patent [19]

Belvederi

[11] Patent Number: 6,105,750

[45] Date of Patent: Aug. 22, 2000

[54] METHOD AND DEVICE FOR TRANSFERRING ARTICLES

[75] Inventor: Bruno Belvederi, S. Martino Di Monte S. Pietro, Italy

[73] Assignee: G. D Societa' per Azioni, Bologna, Italy

[21] Appl. No.: 09/129,712

[22] Filed: Aug. 5, 1998

[30] Foreign Application Priority Data

Aug. 8, 1997 [IT] Italy ..... BO97A0503

[51] Int. Cl.[7] ..... B65G 47/26

[52] U.S. Cl. ..... 198/432; 198/450; 198/475.1

[58] Field of Search ..... 198/432, 471.1, 198/475.1, 457.01, 458, 449, 450; 131/282, 283

[56] References Cited

U.S. PATENT DOCUMENTS 4,054,047 10/1977 Sclippa ..... 198/450
4,827,948 5/1989 Schumacher ..... 198/471.1
5,033,482 7/1991 Belvederi et al. .
5,860,427 1/1999 Stivani et al. ..... 198/450

FOREIGN PATENT DOCUMENTS 2238705 6/1991 United Kingdom .

*Primary Examiner*—Jospeh E. Valenza
*Attorney, Agent, or Firm*—Marshall, O'Toole, Gerstein, Murray & Borun

[57] ABSTRACT

A method of transferring elongated articles from a first path to a second path crosswise to the first, whereby the articles are fed longitudinally along the first path in a first and second succession side by side and parallel to each other, and are fed transversely along the second path; the articles in the first succession are picked up by means of a first pickup member, and the articles in the second succession by means of a second pickup member; the first pickup member and respective article are fed along a first portion of a first annular trajectory extending about a first axis; the second pickup member and respective article are fed along a second portion of a second annular trajectory extending about a second axis; and the lengths of the first and second portions depend on the arrangement of the articles along the second path.

2 Claims, 2 Drawing Sheets

METHOD AND DEVICE FOR TRANSFERRING ARTICLES

BACKGROUND OF THE INVENTION

The present invention relates to a method of transferring articles.

In particular, the present invention relates to a method of transferring cigarette portions from a dual-rod cigarette manufacturing machine to a filter-assembly machine.

In the tobacco industry, filter-tipped cigarettes are known to be produced by forming, on a cigarette manufacturing machine, two parallel continuous cigarette rods of tobacco enclosed in respective tubular wrappings; cutting each cigarette rod into cigarette portions twice the length of the cigarette portion of a finished filter-tipped cigarette; and transferring the double cigarette portions from the manufacturing machine to respective seats on the input conveyor of a filter-assembly machine to attach the filters.

At present, the cigarette portions are transferred by means of a pickup member having a pair of parallel, side by side seats, which are fed along an annular trajectory tangent to a pickup station on the manufacturing machine and to the seats of a supply unit for supplying the input conveyor of the filter-assembly machine. That is, the cigarette portions are picked up by the seats on the pickup member, which is maintained parallel to itself along said trajectory, and are released into the seats on the supply unit after traveling along a 90° portion of the trajectory, so that the cigarette portions traveling parallel to their respective longitudinal axes in two parallel orderly successions along a first path on the manufacturing machine are arranged in a single orderly succession along a second path on the filter-assembly machine.

The above transfer method involves several drawbacks, by failing to feed the cigarette portions along two separate paths, as required for supplying a two-line filter-assembly machine or two filter-assembly machines arranged side by side.

In a variation of the above method, the cigarette portions are transferred by means of a pickup member having a pair of parallel, offset seats, which are fed parallel to themselves along an annular trajectory tangent to a pickup station on the manufacturing machine and to the seats of a supply unit for supplying the input conveyor of the filter-assembly machine. This method is substantially similar to the previous one, except that the offset arrangement of the two seats on the pickup member provides for arranging the cigarette portions in two orderly side by side successions along the second path, as required for supplying a two-line filter-assembly machine. On the other hand, such a method is unsuitable for supplying two side by side filter-assembly machines or a single filter-assembly machine with only one line.

Yet another transfer method provides, by means of a first and second pickup member, for picking up respective cigarette portions from the respective successions along the first path; feeding the first and second pickup members and respective cigarette portions along a first and second portion of a first and second annular trajectory respectively; and releasing the cigarette portions in a single orderly succession along a second path.

Such a method lacks versatility, by failing to arrange the cigarette portions in two orderly successions along the second path, as required for supplying a two-line filter-assembly machine.

SUMMARY OF THE INVENTION

It is an object of the present invention to provide a method of transferring articles, designed to eliminate the aforementioned drawbacks, and which in particular provides for a high degree of versatility by arranging the articles in one or two separate successions along the second path.

According to the present invention, there is provided a method of transferring elongated articles from a first path, extending in a first direction, to a second path extending in a second direction crosswise to the first direction; said articles being fed longitudinally along said first path in a first and a second succession side by side and parallel to each other, and being fed transversely along said second path in a given arrangement; the method comprising the steps of picking up the articles in the first succession by means of a first pickup member, and picking up the articles in the second succession by means of a second pickup member; and feeding the first pickup member and respective article along a first portion of a first annular trajectory extending about a first axis, and feeding the second pickup member and respective article along a second portion of a second annular trajectory extending about a second axis; the method being characterized in that said first and said second portion are of a length depending on said given arrangement of the articles along said second path.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
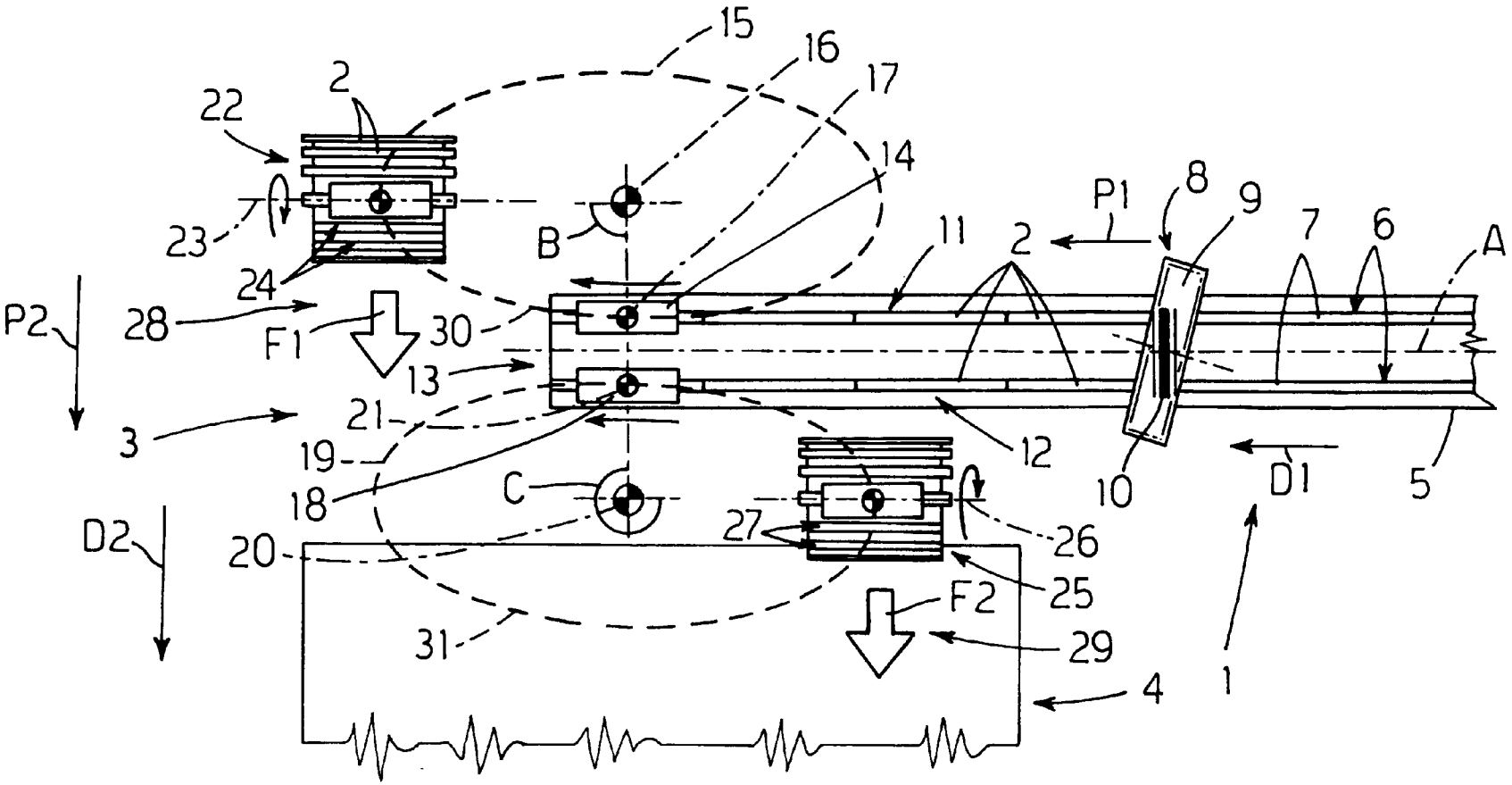
FIG. 1 shows a schematic view of a given operating configuration of a device by which to implement the method according to the invention.

Number 1 in FIG. 1 indicates a cigarette manufacturing machine for producing cigarette portions 2, which are picked up by a transfer device 3 and transferred to a two-line filter-assembly machine 4.

Manufacturing machine 1 comprises a bed 5 having two parallel guides 6 located on opposite sides of the axis A of bed 5 and defining a path P1; two continuous cigarette rods 7 are fed along respective guides 6 in a traveling direction D1; a cutting station 8 is located along path Pi, and comprises a roller 9 having a cutter 10 for cutting rods 7 into portions 2; and portions 2 are fed longitudinally along guides 6 in direction D1, and are therefore arranged in two parallel orderly successions 11 and 12.

A pickup station 13 is located along path P1, downstream from cutting station 8 in direction D1.

Transfer device 3 comprises a number of pickup members 14 (only one shown in FIG. 1) having respective seats (not shown) and movable along an annular trajectory 15 extending about a given axis 16 crosswise to direction D1. Members 14 are equally spaced about axis 16, and rotate about respective axes 17 so as to travel parallel to themselves along annular trajectory 15.

Device 3 also comprises a number of pickup members 18 (only one shown in FIG. 1) having respective seats (not shown) and movable along an annular trajectory 19 extending about a given axis 20 crosswise to direction D1. Pickup members 18 are equally spaced about axis 20, and rotate about respective axes 21 so as to travel parallel to themselves along annular trajectory 19. Annular trajectories 15 and 19 extend on opposite sides of axis A, and are traveled in opposite directions by respective members 14 and 18: in FIG. 1, pickup members 14 revolve clockwise about axis 16, and pickup members 18 anticlockwise about axis 20.

Device 3 also comprises a drum 22, which rotates about a respective axis 23 parallel to direction D1 and intersecting axis 16, and in turn comprises a succession of seats 24 parallel to and equally spaced about axis 23. Drum 22 is located along annular trajectory 15 so as to successively position seats 24 tangent to annular trajectory 15.

Device 3 also comprises a drum 25, which, like drum 22, rotates about a respective axis 26 parallel to direction D1 and intersecting axis 20, and in turn comprises a succession of seats 27 parallel to and equally spaced about axis 26. Drum 25 is located along annular trajectory 19 so as to successively position seats 27 tangent to annular trajectory 19.

Drums 22 and 25 feed respective orderly successions 28 and 29 of portions 2 along a path P2 extending in a direction D2 crosswise to direction D1. In FIG. 1, orderly successions 28 and 29 are indicated by respective arrows F1 and F2.

In actual use, pickup member 14 picks up a portion 2 from orderly succession 11 at station 13, and travels, together with portion 2, along trajectory 15, while at the same time rotating about both axis 16 and respective axis 17. After traveling along a trajectory portion 30 defining an angle B of 90°, pickup member 14 releases portion 2 inside a seat 24 on drum 22, so that seats 24 on drum 22 are filled with portions 2 transferred from bed 5, and feed portions 2 transversely and in orderly succession 28 in direction D2.

Similarly, pickup member 18 picks up a portion 2 from orderly succession 12 at station 13, and travels, together with portion 2, along trajectory 19, while at the same time rotating about both axis 20 and respective axis 21. After traveling along a trajectory portion 31 defining an angle C of 270°, pickup member 18 releases portion 2 inside a seat 27 on drum 25, so that seats 27 on drum 25 are filled with portions 2 transferred from bed 5, and feed portions 2 transversely in direction D2 and in orderly succession 29 parallel to orderly succession 28. Portions 2 in succession 29 are separated by an axial distance L from portions 2 in succession 28.

Figure 2:
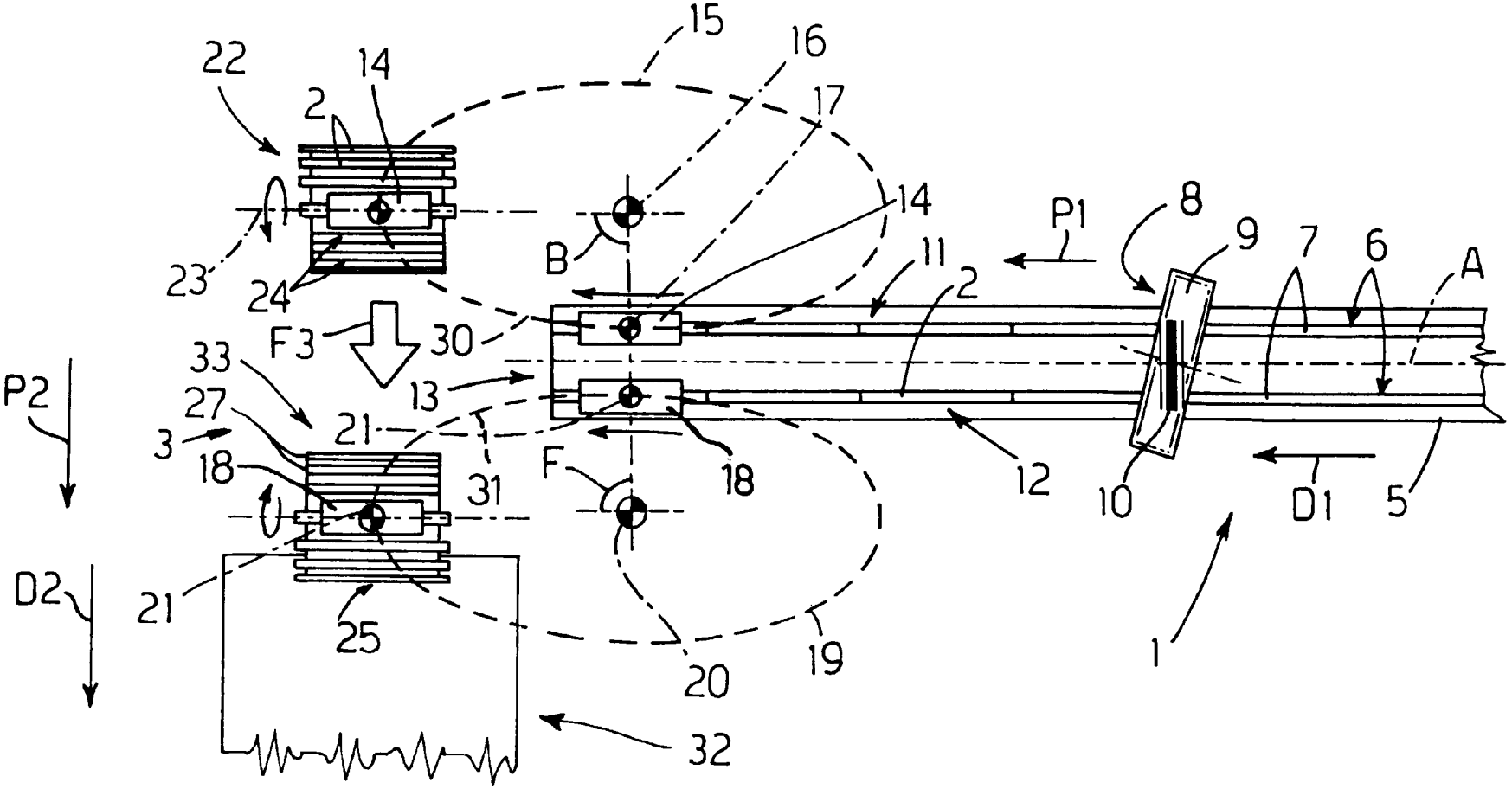
FIG. 2 shows a schematic view of a second operating configuration of the FIG. 1 device.

In the FIG. 2 variation, two-line filter-assembly machine 4 is replaced by a one-line filter-assembly machine 32, and drum 25 is aligned with drum 22 in direction D2 and tangent to trajectory 19, so that pickup member 18 feeds respective portion 2 along a portion 31 of trajectory 19 defining an angle F of 90°, and releases portion 2 inside a vacant seat 27 on drum 25.

A single orderly succession 33 of portions 2—indicated by arrow F3 in FIG. 2—is therefore formed and fed along path P2 to one-line filter-assembly machine 32.

In other words, various arrangements of portions 2 along path p2 (in addition to the ones shown in FIGS. 1 and 2) may be obtained, depending on the location of drums 22 and 25 along respective trajectories 15 and 19 of respective pickup members 14 and 18, and on the length of portions 30 and 31 along which portions 2 are fed along trajectories 15 and 19.

What is claimed is:

1. A method of transferring elongated articles from a first path, extending in a first direction, to a second path extending in a second direction crosswise to the first direction; said articles being fed longitudinally along said first path in a first and a second succession side by side and parallel to each other, and being fed transversely along said second path in a given arrangement; the method comprising the steps of picking up the articles in the first succession by means of a first pickup member, and picking up the articles in the second succession by means of a second pickup member; and feeding the first pickup member and respective article along a first portion of a first annular trajectory extending about a first axis, and feeding the second pickup member and respective article along a second portion of a second annular trajectory extending about a second axis; wherein said first and said second portion are of a length depending on said given arrangement of the articles along said second path; the first annular trajectory being of a total length equal to the length of the second annular trajectory; the length of the first portion being a function of a respective first angle defined by said first portion; and the length of the second portion being a function of a respective second angle defined by said second portion; the first and second pickup members traveling in opposite directions along the respective first and second annular trajectories; said first angle being an angle of 90°, and said second angle being an angle of 270°; said given arrangement comprising a third and a fourth orderly succession separated by an axial distance.

2. A method of transferring elongated articles from a first path, extending in a first direction, to a second path extending in a second direction crosswise to the first direction; said articles being fed longitudinally along said first path in a first and a second succession side by side and parallel to each other, and being fed transversely along said second path in a given arrangement; the method comprising the steps of picking up the articles in the first succession by means of a first pickup member, and picking up the articles in the second succession by means of a second pickup member; and feeding the first pickup member and respective article along a first portion of a first annular trajectory extending about a first axis, and feeding the second pickup member and respective article along a second portion of a second annular trajectory extending about a second axis; wherein said first and said second portion are of a length depending on said given arrangement of the articles along said second path; the first annular trajectory being of a total length equal to the length of the second annular trajectory; the length of the first portion being a function of a respective first angle defined by said first portion; and the length of the second portion being a function of a respective second angle defined by said second portion; the first and second pickup members traveling in opposite directions along the respective first and second annular trajectories; said first angle being an angle of 90°, and said second angle being an angle of 90°; said given arrangement comprising a third orderly succession along said second path.

* * * * *